US009220963B2

(12) United States Patent
Miceli et al.

(10) Patent No.: US 9,220,963 B2
(45) Date of Patent: Dec. 29, 2015

(54) LACROSSE STICK HEAD

(71) Applicants: James Miceli, Eden Prairie, MN (US); Philip Naumburg, Fort Collins, CO (US)

(72) Inventors: James Miceli, Eden Prairie, MN (US); Philip Naumburg, Fort Collins, CO (US)

(73) Assignee: Epoch Lacrosse LLC

( * ) Notice: Subject to any disclaimer, the term of this patent is extended or adjusted under 35 U.S.C. 154(b) by 167 days.

(21) Appl. No.: 13/870,333

(22) Filed: Apr. 25, 2013

(65) Prior Publication Data

US 2014/0323249 A1 Oct. 30, 2014

(51) Int. Cl.
*A63B 59/02* (2006.01)

(52) U.S. Cl.
CPC ..... *A63B 59/02* (2013.01)

(58) Field of Classification Search
CPC ..... A63B 59/02
USPC ..... 473/505, 512, 513; D21/724
See application file for complete search history.

(56) References Cited

U.S. PATENT DOCUMENTS

| | | | | |
|---|---|---|---|---|
| D350,999 | S * | 9/1994 | Chen | D21/724 |
| 5,494,297 | A | 2/1996 | MacNeil | |
| 5,568,925 | A | 10/1996 | Morrow et al. | |
| RE38,216 | E | 8/2003 | Morrow et al. | |
| 2004/0224798 | A1 * | 11/2004 | Brine et al. | 473/513 |
| 2005/0215360 | A1 * | 9/2005 | Gait | 473/513 |
| 2010/0113191 | A1 * | 5/2010 | Winningham et al. | 473/513 |
| 2014/0323249 | A1 * | 10/2014 | Miceli et al. | 473/513 |

OTHER PUBLICATIONS

STX 2005 Catalog, 2005, 9 pages.*

Web page download, youtube2012, 2012, https://www.youtube.com/watch?v=90LHvlscX9E&t=15. 7 pages.*

* cited by examiner

*Primary Examiner* — Gene Kim
*Assistant Examiner* — M Chambers
(74) *Attorney, Agent, or Firm* — H. Jay Spiegel

(57) ABSTRACT

A head includes front surfaces and rear surfaces. The front surfaces are uncurved. A proximal portion of the front surfaces slopes gradually downwardly and a distal end of the front surfaces slope more dramatically toward the axis of elongation of the socket. The rear surfaces of the head slope downwardly until at approximately 60% of the distance in the proximal to distal direction, a deep pocket is provided, the rear surfaces curving back upwardly to converge toward the front surfaces and then curve back downwardly to meet at the arcuate distal scooping end of the head. A series of spaced holes are provided to facilitate stringing of a webbing about the rear surfaces of the head to provide a mid/high pocket.

20 Claims, 7 Drawing Sheets

LACROSSE STICK HEAD

BACKGROUND OF THE INVENTION

The present invention relates to an improved lacrosse stick head. The game of lacrosse was developed by native Americans perhaps as long ago as close to a millennium ago. Originally, the lacrosse stick was made of materials including wood. In recent years, synthetic materials and composites have been employed in manufacturing the various components of a lacrosse stick. Into the 1970s, the head of the stick was still being made out of wood. More recently, materials such as molded plastic have been employed in manufacturing the head of the stick which is otherwise referred to as the "crosse."

Since plastic was introduced as the key material for a lacrosse head, the most significant advancement made has been the introduction of the off-set head. While this off-set curved head has advanced the game in several respects, it certainly does not most effectively achieve the results desired by a lacrosse player carrying a stick with such a head.

Curved heads such as disclosed in U.S. Pat. No. 5,568,925 (the '925 patent), issued Oct. 29, 1996, to Morrow et al., and assigned to Warrior Lacrosse, Inc., are designed to help the ball sit deep into a pocket created by webbing when the ball is cradled and being handled. The '925 patent was reissued on Aug. 12, 2003, as U.S. Pat. No. RE 38,216. Such a head creates a spoon-like shape. However, Applicants have discovered that such a head actually decreases the effectiveness of a player when passing and shooting. While the head curvature provides an increased feel for the ball when the ball is being cradled and handled, its particular configuration forces a player to alter their natural throwing motion to compensate for the particular characteristics of the head. To compensate for the head design, players often must throw "lob" passes rather than throwing crisp, hard passes to a teammate. As a result, it is difficult for a lacrosse team to whip the ball around the attack zone in an attempt to find an open shot and it is equally difficult for a team to throw crisp passes in an effort to clear the ball against an aggressive opponent.

An additional aspect concerning lacrosse heads currently known is that players are always trying to find ways to increase their ability to retain the ball within the webbing of the head when being challenged by an opponent. Players are continually seeking new ways to string their lacrosse heads within the rules of the game to legally facilitate enhanced hold of the ball within the webbing of the stick head. Stringing used to create the webbing typically consists of Nylon or other woven material laced onto the head using peripheral holes provided so that an area is created for the ball to be received and handled during play. By stringing the webbing strings tighter, a barrier may be created to prevent the ball from being easily dislodged from the scoop portion of the head. Often, the stringing process confronts compromises between enhancing the ability to retain the ball within the webbing, the ability to pass, and the ability to shoot. These three aspects are quite subjective in nature and some players seek to string their lacrosse heads to enhance one or the other of these factors.

Some players are stringing their stick heads in an attempt to cause the ball to be retained closer to the distal end of the stick. While this enhances shooting ability, it reduces ball retention. Such a stringing creates what is known as a "high pocket" as compared to a mid-pocket or a low pocket closer to the location where the handle is attached to the head of a lacrosse stick. As should be evident, it would be advantageous for there to be a lacrosse stick head which enhances the abilities to retain the ball within the head, accurately and crisply pass it to a teammate, and accurately and strongly shoot the ball to the goal.

The '925 patent, later reissued, discloses a lacrosse head which is illustrated herein in FIG. 1 (which corresponds to FIG. 6 in the '925 patent and its reissue). In particular, the head 22 includes a socket 40 designed to receive a handle and having an axis of elongation 42. The plane 48 shown in FIG. 1 is parallel to the axis 42. The head has front side edges 46 and back side edges 50 as shown. These edges 46 and 50 curve downwardly in the proximal to distal direction until they reach a lowermost extent at approximately the location of the double-headed arrow 52, whereupon they reverse course in parallel fashion and begin to ascend, whereupon, the front side edges 46 cross over the plane 48 and then curve downwardly again to terminate at the distal end surface 60. The back side edges 50 travel in parallel fashion to the front side edges 46 until approximately the location where the front side edges 46 cross the plane 48, at which point the back side edges 50 begin to converge with the front side edges and then curve back to arrive at the surface 60 at the distal end of the head. This configuration creates a spoon-like structure and, when webbing is attached to the head 22 using the holes 38, a pocket is provided having its lowermost location approximately below the location of the double-headed arrow 52 which is well proximal of the lip surface 64 at the distal end of the stick. This may be best characterized as a mid/low pocket configuration. Applicants have found that this configuration of stick head includes all of the deficiencies described above concerning, particularly, the inability to strike an advantageous compromise between retention of the ball within the head, the ability to crisply pass the ball, and the ability to accurately and strongly shoot the ball toward the goal.

In designing a lacrosse stick head, the National Collegiate Athletic Association (NCAA) has formulated what it describes as "Crosse Specifications" which are the standard requirements for all lacrosse stick heads (crosses). Those regulations are found in Rule 1 of the Lacrosse Rules, Sections 17-19, and in Appendix IV to those Specifications. The present invention complies with all of those rules and regulations.

It is with these deficiencies in mind that the present invention was developed.

SUMMARY OF THE INVENTION

The present invention relates to an improved lacrosse stick head. The present invention includes the following interrelated objects, aspects and features:

(1) The inventive head includes a proximal end having a recess/socket designed to facilitate insertion and fastening of a handle. The handle has an axis of elongation.

(2) Extending in the distal direction, the head has front surfaces and rear surfaces. The front surfaces are uncurved and include a proximal portion and a distal portion. The proximal portion slopes gradually downwardly from a plane above and parallel to the axis of elongation of the socket and toward, but not reaching that axis.

(3) The distal end of the front surfaces of the head slope more dramatically toward the axis of elongation of the socket but never reach that axis, terminating at the distal end of the stick comprising an arcuate scooping surface.

(4) The rear surfaces of the stick head slope downwardly from a location below the axis of elongation of the socket until at approximately 60% of the distance in the proximal to distal direction, a deep pocket is provided, whereupon the rear surfaces curve back upwardly to converge toward the front surfaces and then curve back downwardly to meet at the arcuate distal scooping end of the head.

(5) Adjacent the rear surfaces of the head, extending completely about the periphery of the head, a series of spaced holes are provided to facilitate stringing of a webbing about the rear surfaces of the head to provide the "pocket" of the head. As compared to the lacrosse head disclosed in the '925 patent, the pocket created by the inventive stick head is at its deepest much closer to the distal end of the head than is the case with the stick head disclosed in the '925 patent. In fact, the deepest portion of the pocket of the stick head disclosed in the '925 patent may be best described as centrally located to create a "mid-low pocket." By contrast, the stick head of the present invention creates what may be best described as a "mid to high pocket," much closer to the distal end of the head than is the case with the stick head disclosed in the '925 patent and other stick heads currently used.

As such, it is a first object of the present invention to provide an improved lacrosse stick head.

It is a further object of the present invention to provide such a stick head in which the front surfaces of the head are devoid of significant curvature.

It is a still further object of the present invention to provide such a stick head in which the rear surfaces thereof have a curvature which creates an aggressive "mid to high pocket" configuration in which the deepest portion of webbing attached thereto is located much closer to the distal end of the head than is the case with prior art stick heads.

It is a still further object of the present invention to provide such a stick head in which the result is no less ability to retain a ball within the stick but increased ability to crisply pass and shoot the ball.

It is a still further object of the present invention to provide such a stick head which complies with all of the rules and regulations of bodies administering and regulating the game of lacrosse.

These and other objects, aspects and features of the present invention will be better understood from the following detailed description of the preferred embodiment when read in conjunction with the appended drawing figures.

SPECIFIC DESCRIPTION OF THE PREFERRED EMBODIMENT

Figure 1:
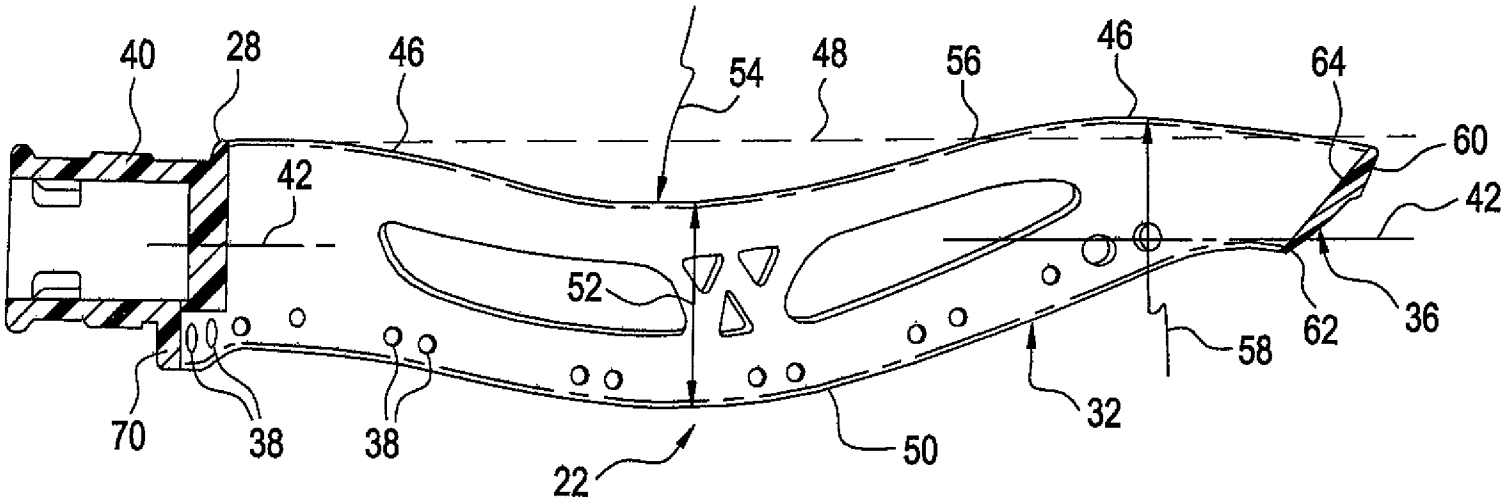
FIG. 1 PRIOR ART
FIG. 1 shows a side view of a prior art scooped lacrosse head as disclosed and claimed in U.S. Pat. No. 5,568,925 and the corresponding Reissue Pat. No. U.S. RE 38,216, and corresponds to FIG. 6 thereof.

Reference is now made to FIGS. 2-5 which depict the inventive improved lacrosse stick head as generally designated by the reference numeral 100. The head 100 has a proximal end 101 and a distal end 103.

At the proximal end 101, attachment means comprising a recess or socket 105 is provided which, in the preferred embodiment, includes an octagonal cross-section 108 (FIGS. 2 and 5) designed to couple with a handle 10 (FIG. 2) of corresponding cross-section.

Figure 3:
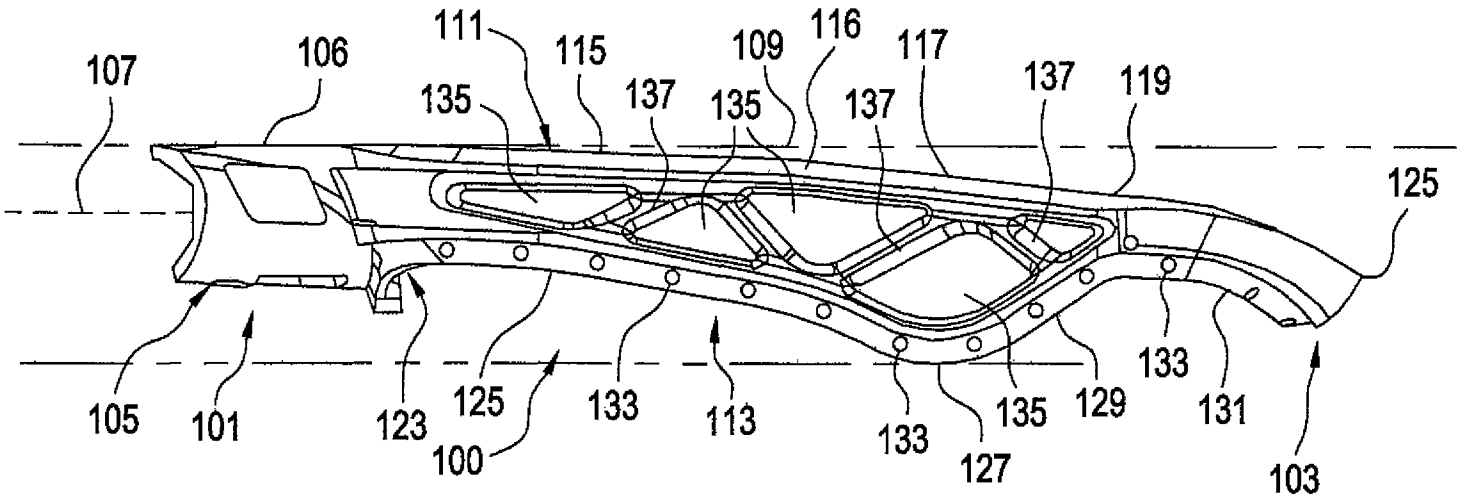
FIG. 3 shows a side view of the present invention.
Figure 4:
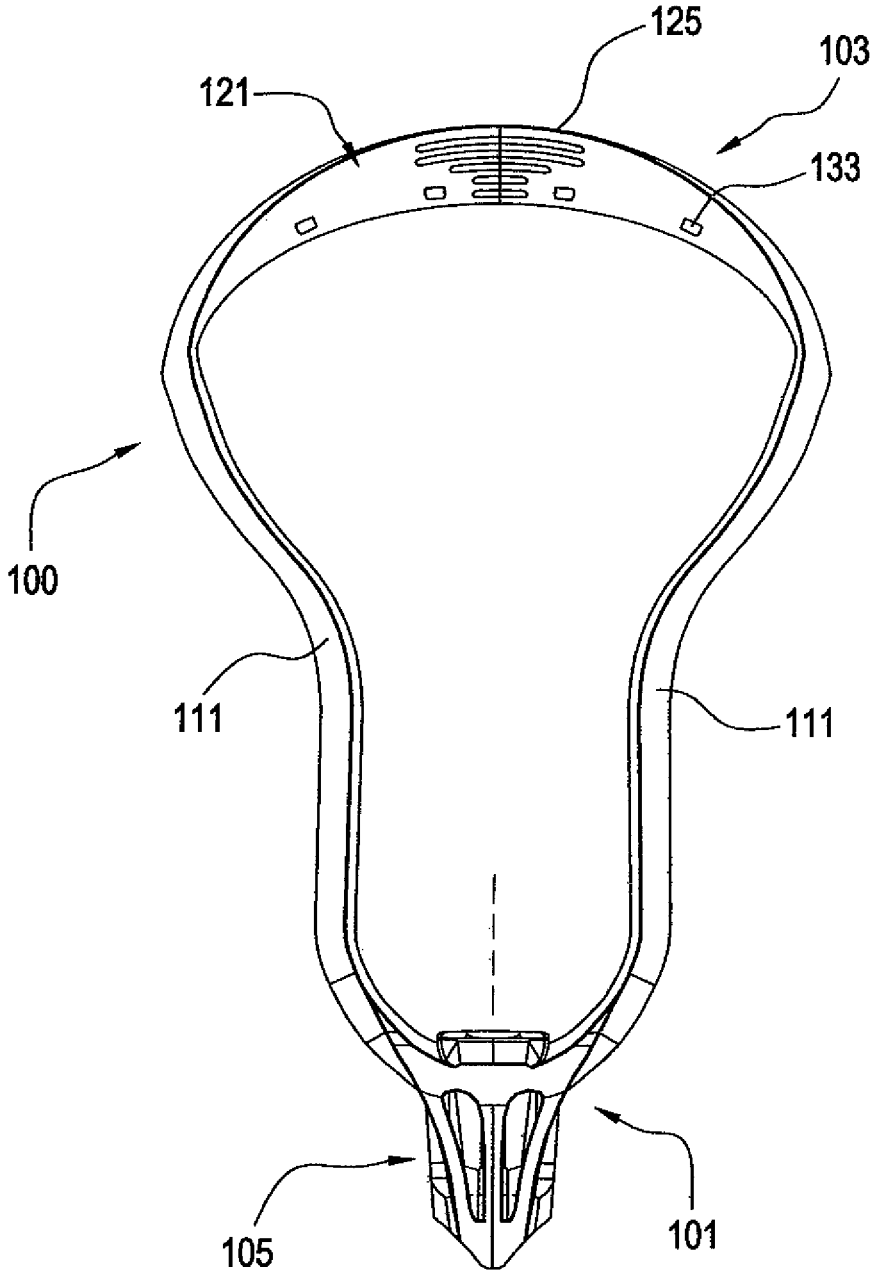
FIG. 4 shows a top view of the present invention.

As seen in FIG. 3, the socket or recess 105 includes an axis 107 of elongation. A plane 109 parallel to the axis of elongation 107 defines an upper extent comprising a top surface 106 of the recess or socket 105.

Figure 2:
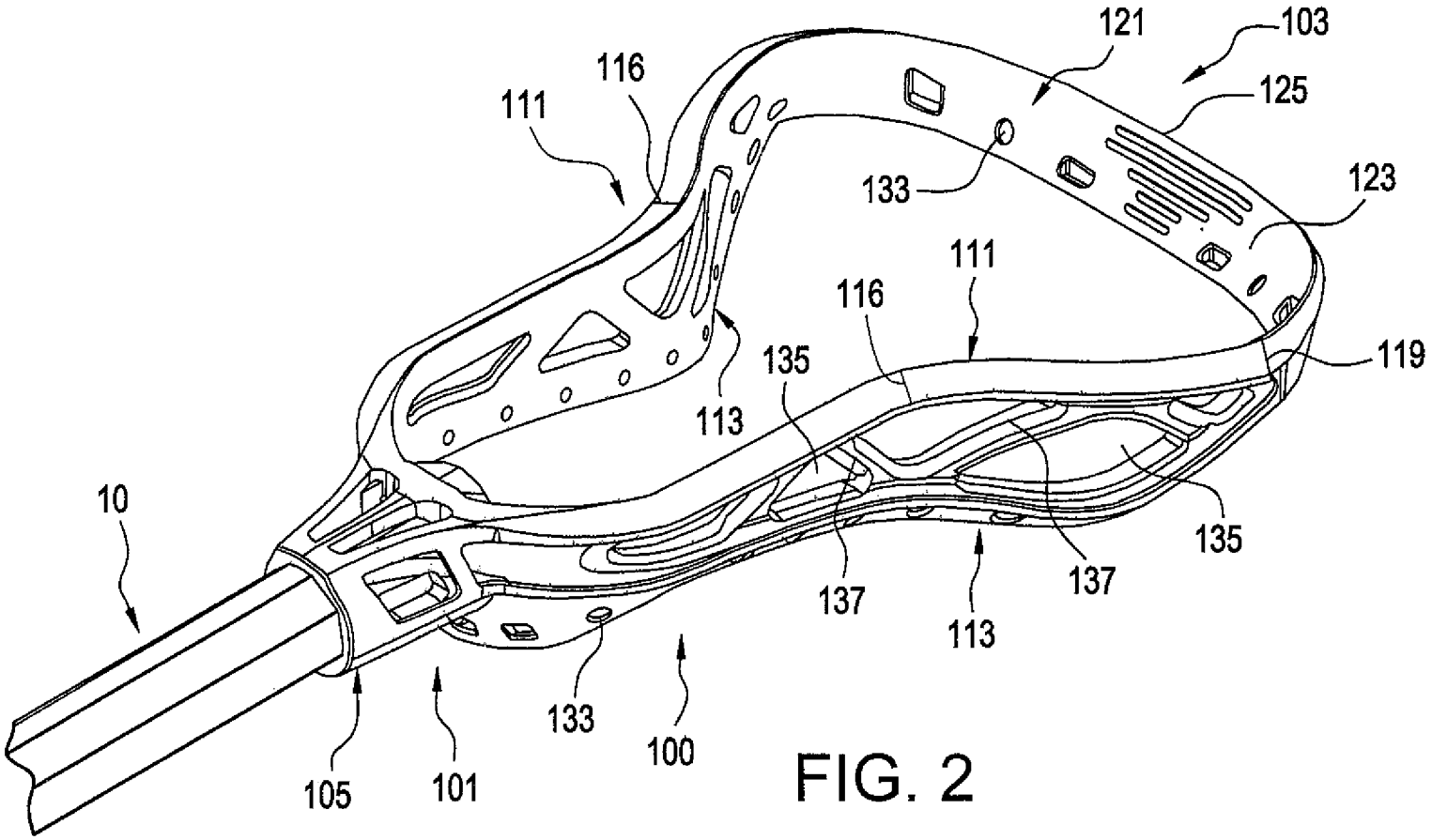
FIG. 2 shows a side rear perspective view of the present invention.
Figure 5:
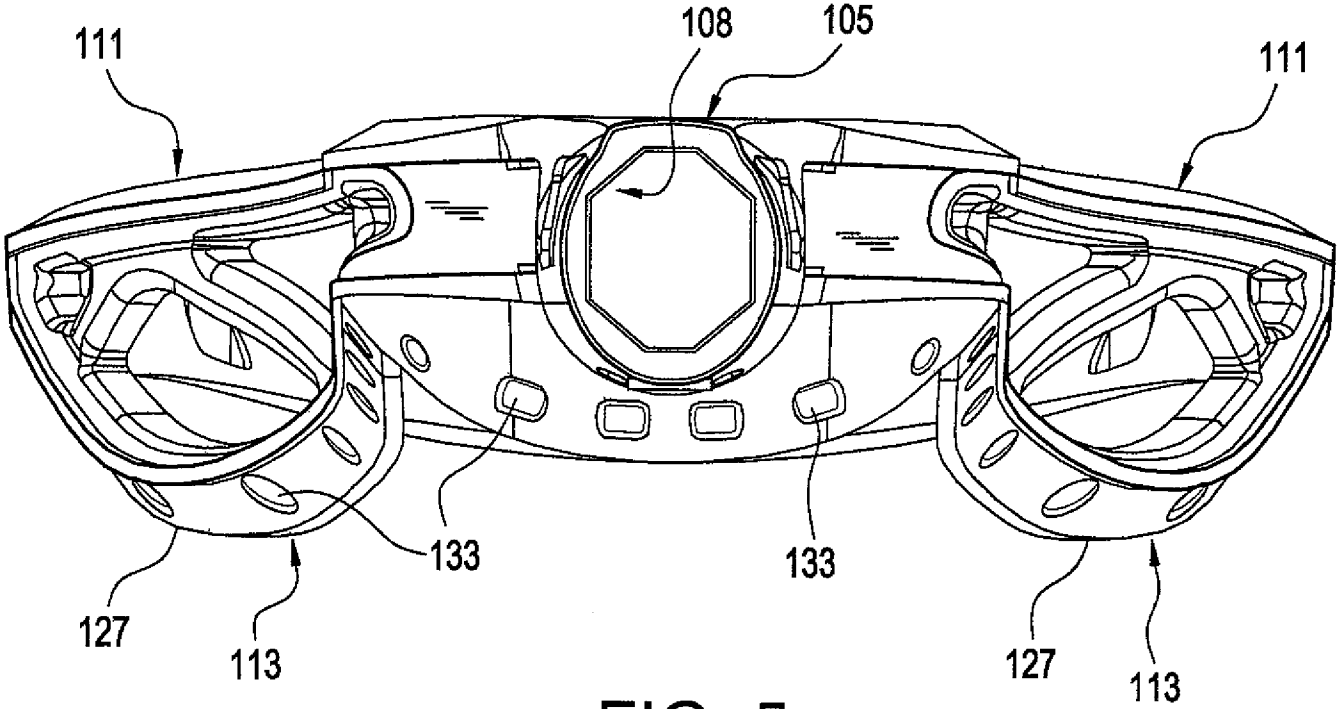
FIG. 5 shows an end view looking distally from the proximal end of the present invention.

The head 100 includes front or top surfaces 111 including two front or top sides extending from the attachment means 105 distally on opposed sides of the head 100 and interconnecting with opposed sides of the lip 121 (FIGS. 2-4) and rear or bottom surfaces 113 including two rear or bottom sides extending from the attachment means 105 distally on opposed sides of the head 100 and interconnecting with opposed sides of the lip 121 (FIGS. 2, 3 and 5).

With particular reference to FIGS. 2 and 3, the front or top surfaces 111 are made up of two main regions. A proximal portion or first region 115 extends from just distal of the socket or recess 105 and extends in a plane to a transition location 116. The first region 115 begins at its proximal end at the plane 109 and is angled slightly downwardly toward the axis 107 at a first angular relation with respect to said upper plane 109. The distal portion or second region of the front surface 111 extends distally from the transition location 116 and is designated by the reference numeral 117. The distal portion extends in a plane at a slightly greater angle with respect to the axis 107 and plane 109 than is the case with the proximal portion 115. This slightly greater angle defines a second angular relation with respect to the upper plane 109 and axis 107. The distal portion 117 continues distally until it meets the distal end 103 of the head 100 at a second transition location 119.

The distal end 103 of the head 100 has the arcuate lip 121 that has an angled surface 123 and a peripheral distal edge 125 (FIG. 2) that best facilitates scooping up a lacrosse ball when the edge 125 engages or is adjacent a ground surface.

With further reference to FIGS. 2, 3 and 5, the rear or bottom surface 113 includes the following surfaces. At their proximal locations, they emanate at a location 123 just distal of the recess or socket 105. From there, in the distal direction, and starting below the axis 107, the rear or bottom surfaces have a first region 125 that extends downwardly, distally and arcuately with increasing radius of curvature until arriving at a lower apex 127 (FIG. 3) approximately 60% of the distance from the location 123 to the distal edge 125. From there, the rear or bottom surfaces double back in a second region and begin curving at a location 129 back toward the axis 107 for a short distance, whereupon they double back at a third region 131 which is a portion of the distal lip 121 below the plane 109. The location of the lower apex 127 creates an aggressive rear surface or bottom rail.

Figure 6:
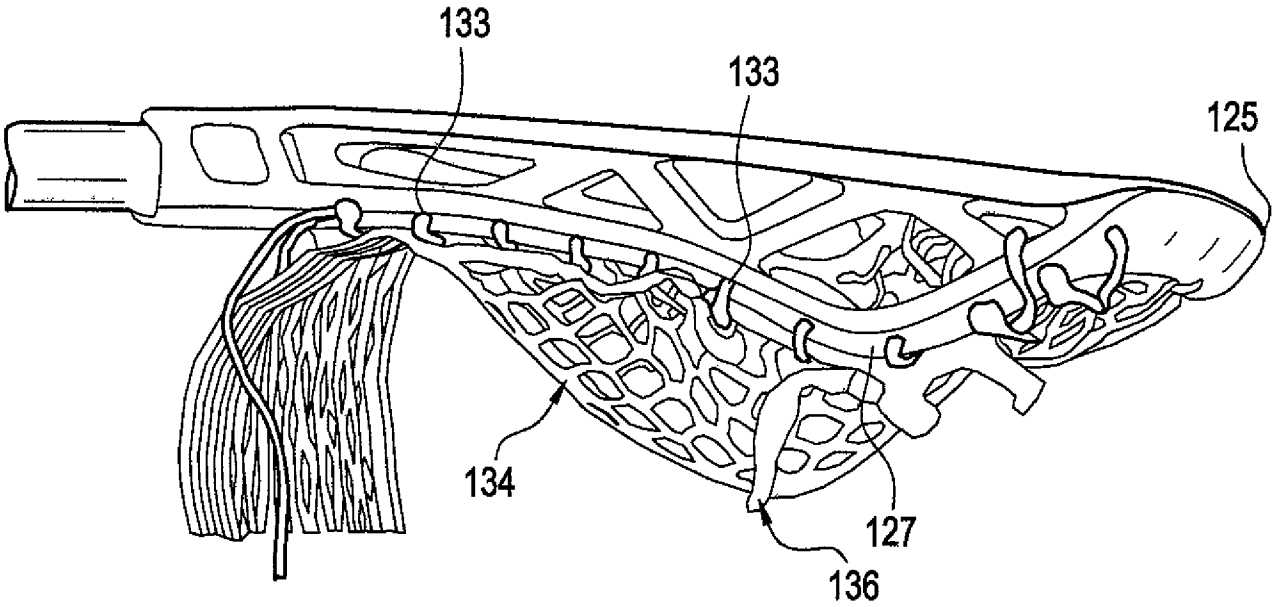
FIG. 6 shows a side view of the present invention with webbing or a pocket assembled thereto.
Figure 7:
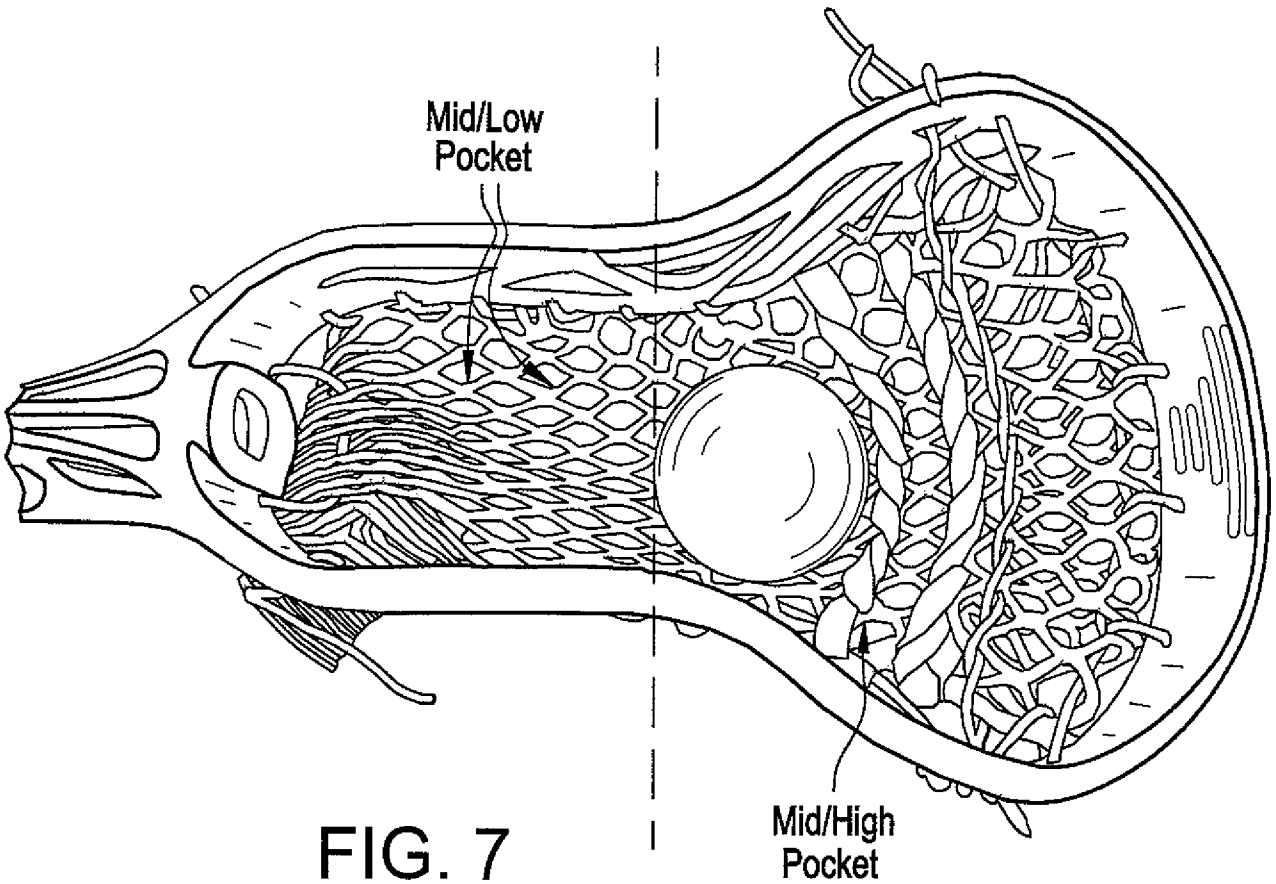
FIG. 7 shows a top view of the structure of FIG. 6.

Just above and adjacent the rear or bottom surfaces of the head 100, attachment location comprising a plurality of holes 133 are provided which are intended to facilitate attaching strings to the head 100 to form a pocket or webbing 134 (FIGS. 6 and 7). This webbing is well understood by those of ordinary skill in the art and the particular shape and configuration of the head 100 goes a long way toward determining the shape and configuration of the webbing and pocket.

In order to lighten the head 100 while maintaining its strength, openings 135 are provided which are defined by structural struts 137 which make up the side surfaces of the head.

As should be understood from comparing FIGS. 1 and 6-7, in the prior art head of FIG. 1, when webbing is installed using the holes 38, the result is creation of a pocket which is best described in the art as a "mid/low pocket" with the deepest portion located from near the proximal end to approximately midway between the proximal and distal ends thereof. By contrast, when the head 100 seen in FIGS. 6-7 is strung with webbing, the result is what is best described as a "mid/high pocket" 136 (FIG. 7) in which the deepest portion of the pocket is closely adjacent the location of transition location 127, much closer to the distal edge 125 of the head 100 than is the case with respect to the head 22 of FIG. 1 in which the deepest portion of the pocket is closely adjacent the location of the reference numeral 22 in FIG. 1.

By moving the deepest portion of the pocket closer to the distal edge 125 of the head 100, Applicants' head 100 assures that the location where the ball will be carried in the head 100 is closer to the edge 125 than is the case with the head 22 with respect to the distal edge 64 thereof See FIGS. 6-7. In this way, the deficiencies of the prior art concerning ball retention, passing ability, and shooting ability are substantially eliminated. Through use of a lacrosse stick bearing a head such as the head 100 of the present invention, the player may carry the ball equally securely as is the case with the head 22 but, by contrast, the player's ability to pass the ball and shoot it toward the goal in a crisper and quicker fashion and with greater velocity is significantly enhanced.

As such, an invention has been disclosed in terms of a preferred embodiment thereof which fulfills each and every one of the objects of the invention as set forth hereinabove, and provides a new and useful improved lacrosse stick head of great novelty and utility.

Of course, various changes, modifications and alterations in the teachings of the present invention may be contemplated by those skilled in the art without departing from the intended spirit and scope thereof.

As such, it is intended that the present invention only be limited by the terms of the appended claims.

The invention claimed is:

1. A lacrosse head, comprising:

a) a proximal end having attachment means for facilitating attachment of a handle, said attachment means having an axis of elongation;

b) said attachment means having an upper extent lying in an upper plane extending parallel to said axis of elongation;

c) a distal end having a lip below said axis of elongation and configured to facilitate scooping a ball into said head;

d) between said proximal and distal ends, top and bottom surfaces, i) said top surface including two top sides extending from said attachment means distally on opposed sides of said head to interconnect with opposed sides of said lip;

ii) said bottom surface including two bottom sides extending from said attachment means distally on said opposed sides and below respective ones of said two top sides to interconnect with said opposed sides of said lip;

e) said top surface commencing at said attachment means at or below said upper plane and extending distally while descending below said upper plane without ascending toward said upper plane, and said bottom surface extending distally from below said axis of elongation, first diverging away from said top surface then beyond a transition location converging toward said top surface until connecting with said lip below said top surface.

2. The lacrosse head of claim 1, wherein said top surface descends linearly in a first region at a first angular relation with respect to said upper plane, and distal of a transition location descends linearly in a second region at a second angular relation with respect to said upper plane.

3. The lacrosse head of claim 2, wherein said second angular relation subtends a greater angle with respect to said upper plane than said first angular relation.

4. The lacrosse head of claim 3, wherein said transition location is about midway between said proximal end and distal end.

5. The lacrosse head of claim 3, wherein said bottom surface commences adjacent a lower extent of said attachment means, said bottom surface extending distally and arcuately away from said upper plane to a transition location and then reverses course, extending arcuately upwardly toward said upper plane until it interconnects with said opposed sides of said lip below said upper plane.

6. The lacrosse head of claim 2, wherein said transition location is about midway between said proximal end and distal end.

7. The lacrosse head of claim 1, wherein said bottom surface commences adjacent a lower extent of said attachment means, said bottom surface extending downwardly, distally and arcuately away from said upper plane to a transition location and then reverses course, extending arcuately upwardly toward said upper plane until it interconnects with said opposed sides of said lip below said upper plane.

8. The lacrosse head of claim 7, further including a plurality of attachment locations spaced about said head for attachment of strings to said head to form a pocket or webbing.

9. The lacrosse head of claim 8, wherein said transition location is at a location about 60% of a distance from said proximal end to said distal end.

10. The lacrosse head of claim 9, wherein said pocket is formed to be deepest at below said transition location to form a mid/high pocket.

11. The lacrosse head of claim 7, wherein said transition location is at a location about 60% of a distance from said proximal end to said distal end.

12. The lacrosse head of claim 1, further including a plurality of attachment locations spaced about said head for attachment of strings to said head to form a pocket or webbing.

13. The lacrosse head of claim 12, wherein said attachment locations comprise holes.

14. The lacrosse head of claim 13, wherein said holes are formed adjacent said rear surface.

15. The lacrosse head of claim 1, wherein between said top surface and bottom surface, said head includes a side surface defined by a plurality of struts and openings between said struts.

16. The lacrosse head of claim 1, wherein said top surface defines an opening allowing said ball entry into said head.

17. A lacrosse head, comprising:

a) a proximal end having attachment means for facilitating attachment of a handle, said attachment means having an axis of elongation;

b) said attachment means having an upper extent lying in an upper plane extending parallel to said axis of elongation;

c) a distal end having a lip below said axis of elongation and configured to facilitate scooping a ball into said head;

d) between said proximal and distal ends, top and bottom surfaces, i) said top surface including two top sides extending from said attachment means distally on opposed sides of said head to interconnect with opposed sides of said lip;

ii) said bottom surface including two bottom sides extending from said attachment means distally on said opposed sides and below respective ones of said two top sides to interconnect with said opposed sides of said lip;

e) said top surface commencing at said attachment means at or below said upper plane and extending distally while descending below said upper plane without ascending toward said upper plane, and said bottom surface extending distally from below said axis of elongation, first diverging away from said top surface then beyond a transition location converging toward said top surface until connecting with said lip below said top surface;

f) wherein said top surface descends linearly at a first angular relation with respect to said upper plane, and distal of a first transition location descending linearly at a second angular relation with respect to said upper plane; and g) said bottom surface first extending downwardly, distally and arcuately away from said upper plane to a second transition location and then second reversing course, extending arcuately upwardly toward said upper plane until it interconnects with said opposed sides of said lip below said upper plane.

18. The lacrosse head of claim 17, wherein said second transition location is at a location about 60% of a distance from said proximal end to said distal end.

19. The lacrosse head of claim 17, wherein said second angular relation subtends a greater angle with respect to said upper plane than said first angular relation.

20. The lacrosse head of claim 17, wherein said top surface defines an opening allowing said ball entry into said head, further including a plurality of spaced holes about said head and adjacent said bottom surface for attachment of strings to said head to form a mid/high pocket.

* * * * *